United States Patent [19]

Thacker

[11] 4,343,286

[45] Aug. 10, 1982

[54] ARCHERY BOW

[76] Inventor: Bobby J. Thacker, 505 Dranesville Rd., Herndon, Va. 22070

[21] Appl. No.: 27,732

[22] Filed: Apr. 6, 1979

[51] Int. Cl.[3] ..... F41B 5/00

[52] U.S. Cl. ..... 124/24 R; 124/88; 124/41 A; 124/41 B

[58] Field of Search ..... 124/24 R, 41 B, 88, 124/86, 80, 27, 25

[56] References Cited

U.S. PATENT DOCUMENTS

| | | | |
|---|---|---|---|
| 785,050 | 3/1905 | Saunders | 124/25 |
| 2,714,377 | 8/1955 | Mulkey | 124/24 R |
| 2,786,461 | 3/1957 | Pelsue | 124/41 B X |
| 3,167,062 | 1/1965 | Zwickey | 124/23 R |
| 3,834,368 | 9/1974 | Geiger | 124/23 R X |

*Primary Examiner*—Richard C. Pinkham
*Assistant Examiner*—William R. Browne
*Attorney, Agent, or Firm*—Shlesinger, Arkwright, Garvey & Dinsmore

[57] ABSTRACT

An archer's bow, the center of which is constructed to permit an unimpeded, dead center flight of the arrow as it leaves the bow. A magnetic, suspension type arrow rest holds the arrow directly in the center of the bow at full draw, the arrow rest being retracted upon release of the arrow. A hand held brace connected to the bow limbs by flexible lines, enables a resultant force to be exerted on the center of the bow.

20 Claims, 9 Drawing Figures

ARCHERY BOW

BACKGROUND OF THE INVENTION

In the sport of archery, wherein conventional bows and arrows are employed, several structural characteristics of the bows materially affect the accuracy of the archer. One example of such characteristics is the positioning of the arrow, when drawn, at a point which is to one side of the bow, and not directly in line with the target in the plane of the bow. Another characteristic of a conventional bow which materially affects accuracy is that it is not possible to grasp the bow in a manner to push dead center thereon, the archer being forced to push low on the handle of the bow below the center thereof, and compensate on the better bows with different strength limbs.

Attempts have been made to change some of these characteristics to effect greater accuracy by various means, such as shown in U.S. Pat. No. 2,344,799 granted Mar. 21, 1944 to Thomas B. Brown et al and U.S. Pat. No. 3,342,173 granted Sept. 19, 1967 to Eugene L. Ferguson. Although these patents are stated to provide means for increasing the accuracy of the archer, they are concerned only with limited objectives for doing so, and do not take into account other factors which equally affect accuracy in archery.

SUMMARY OF THE INVENTION

The present invention is an archery bow having upper and lower limbs which are separated at the center of the bow, the adjacent portions thereof being joined by a connector assembly, which assembly is offset from the center of the bow to permit dead center flight of the arrow unimpeded by any parts of the bow.

In order to properly position and hold the arrow in place when the bow is pulled to full draw, there is provided a magnetic, suspension type arrow rest which is movably mounted on the connector assembly, the arrow rest being operable to exactly and automatically position the arrow dead center of the bow, which arrow rest is retracted upon shooting the arrow, to move the same out of the path of the arrow fletching when the arrow is fired.

This invention further includes an archer's brace having a hand grip, the brace being connected to the bow above and below the center thereof by flexible lines which co-operate to effect a dead center resultant force on the bow when it is drawn.

The present bow enables the full force of the drawn bow to be exerted precisely between the nocking point on the bow string and the dead center of the bow and virtually eliminates the minor variations in one's bow grip from shot to shot which would otherwise induce inconsistencies in the shooting pattern.

With the archery bow of the present invention, there is provided a stable, tension-free bow which never interferes with the dead center flight of the arrow when released.

DETAILED DESCRIPTION OF THE INVENTION ILLUSTRATED IN FIGS. 1 TO 7

Figure 1:
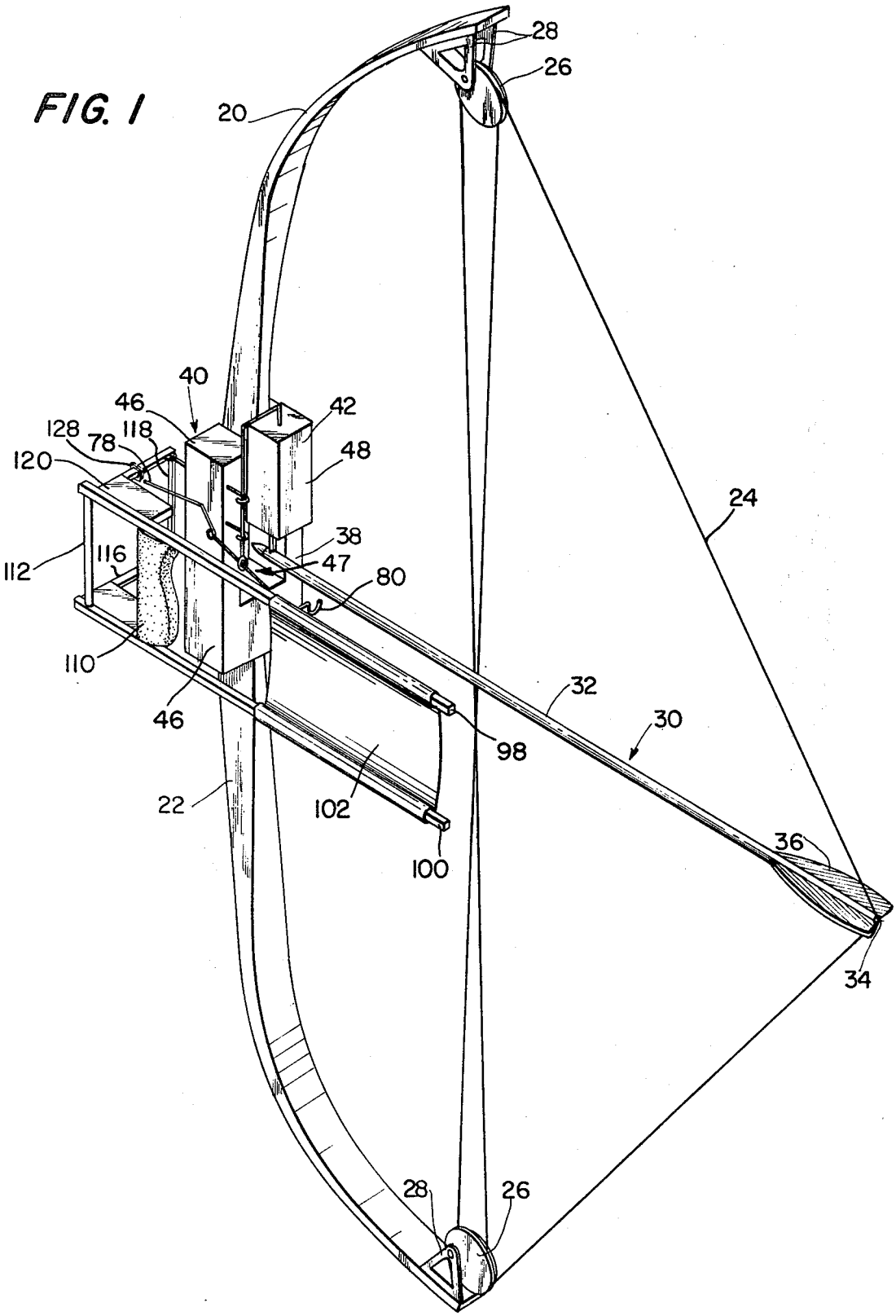
FIG. 1 is a perspective view of a compound bow, illustrating the use of the present invention.

In FIG. 1, there is illustrated a compound bow of basically conventional construction including an upper limb 20, a lower limb 22, a draw string 24 and pulleys 26 which are eccentrically and rotatably mounted between supports 28. A conventional arrow is generally designated 30 and includes a shaft 32, one end of which is provided with a bow string notch 34 adjacent which is fletching 36. The opposite end of shaft 32 is provided with a point or pile 38 of a magnetically attracted material, such as metal having a portion 39 threaded into shaft 32.

In accordance with the present invention, upper limb 20 and lower limb 22 are spaced apart at the center of the bow, and joined by a connector assembly 40 which is offset from the center of the bow, and connected to the upper and lower limb in any suitable manner. A magnetic, suspension-type arrow rest 42 is mounted on connector assembly 40 proximate the center of the bow. A combination archer's brace and arm guard 44 is engaged with the front portions of the upper and lower limbs adjacent the center of the bow.

As shown to advantage in FIGS. 4 to 7, a connector assembly 40 includes a block member 46 having a central opening designated 47 which is aligned with the center of the bow. This opening permits arrow 30 to be fired centrally of the bow rather than to one side thereof.

Magnetic arrow rest 42 is mounted on a rear face of block 46 in any suitable manner. Arrow rest 42 includes a non-magnetic box-like housing 48 having an upper chamber 50 and a lower chamber 52 divided by an intermediate wall 54.

A large permanent magnet 56 is disposed within upper chamber 50 and normally rests on intermediate wall 54. Housing 48 further includes a top wall 58 having a central opening 60, and a thickened bottom wall 62 having a central opening 64.

Figure 4:
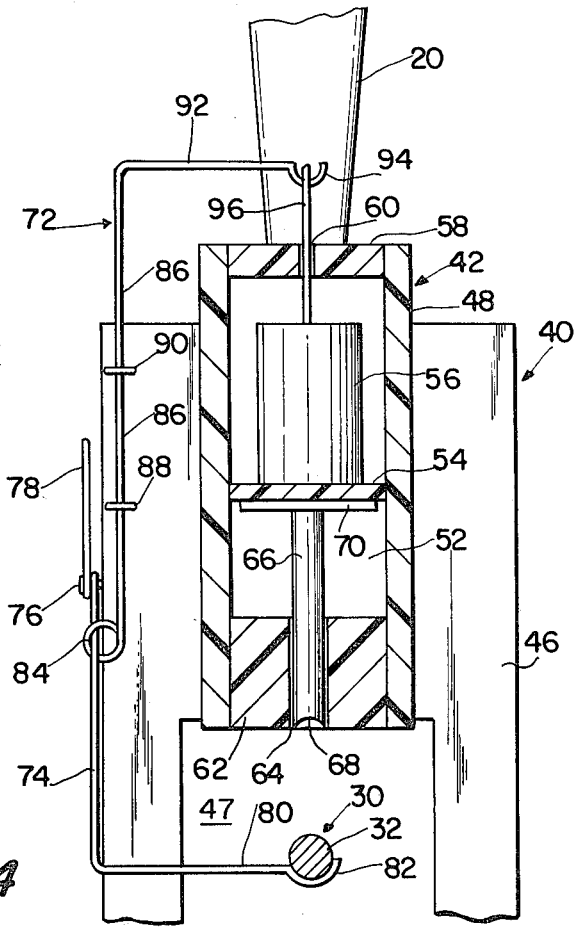
FIG. 4 is an enlarged, fragmentary front elevational view of the bow of the present invention, illustrating to advantage the initial engagement of the arrow with the magnetic, suspension-type arrow rest forming a part thereof, portions thereof being removed to disclose details of construction.

As shown in FIG. 4, arrow rest 42 further includes a smaller, elongated magnet 66 of cylindrical shape which is positioned in lower chamber 52, the cylindrical magnet being held within the lower chamber by virtue of magnetic attraction to magnet 56 which draws magnet 66 upwardly toward intermediate wall 54. The lower end of the magnet is arcuate as indicated at 68 and the upper end thereof is affixed to a rectangular alignment member 70 which, by virtue of its location in space 52 of boxlike housing 48 prevents rotational movement thereof, thereby assuring maximum contact of arcuate end 68 of cylindrical magnet 66 with the peripheral surface of arrow 30. It will be noted from FIG. 4 that when magnet 66 is in the fully retracted position, alignment member 70 is flush with wall 54, and the lower end of the magnet is substantially uniplaner with the lower face of bottom wall 62.

Arrow rest 42 further includes a combination magnet lifter and arrow arm support 72 comprising an elongated arm 74 which is looped intermediate its length, and pivotally connected at 76 to arrow rest 42. One end of elongated arm 74 serves as a finger actuating member as indicated at 78 for rotating arm 74 about pivot point 76. The end of arm 74 opposite actuating member 78 is bent at a right angle as indicated at 80 and terminates in an arcuate arrow support 82.

Intermediate pivot 76 and right angle portion 70, elongated arm 74 passes through an eye 84 of a vertical shaft 86 which extends through eye members 88 and 90 which are affixed to box-like housing 48. The upper end of vertical shaft 86 is bent at a right angle to provide a support arm 92 which terminates in a hook portion 94.

Vertical shaft 86 is adapted to reciprocate up and down in a vertical direction in response to corresponding movement of that portion of elongated arm 74 which passes through eye 84.

Figure 5:
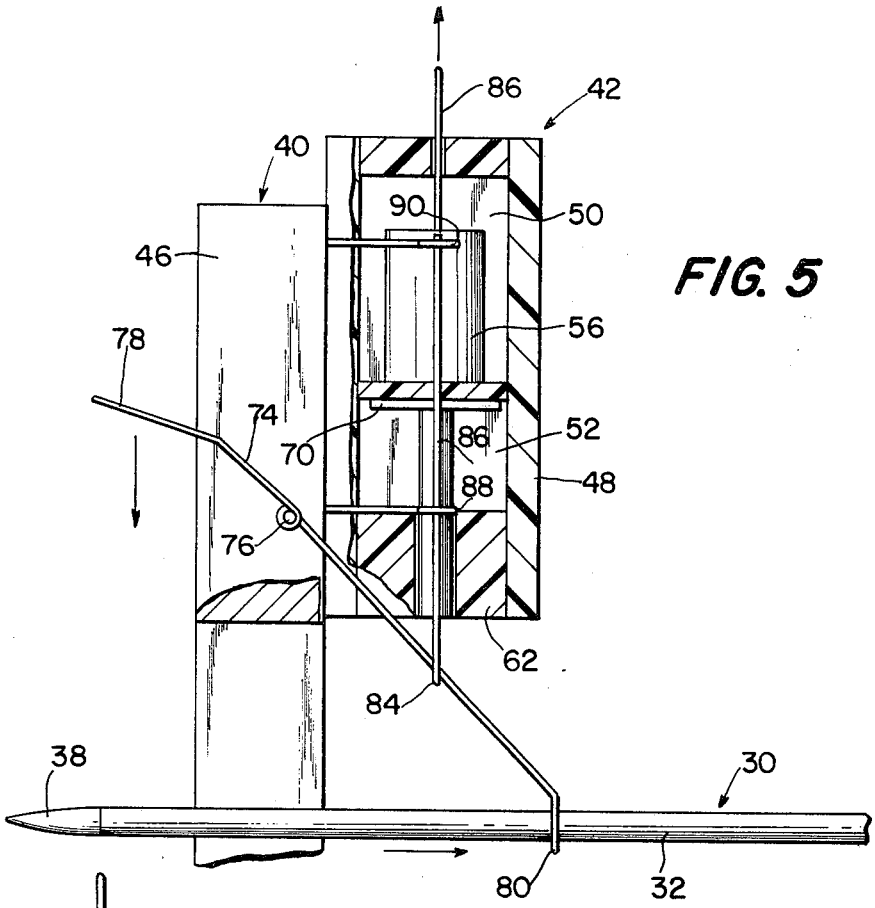
FIG. 5 is an enlarged, fragmentary side elevational view of the magnetic, suspension-type arrow rest, showing the arrow in the same position as in FIG. 4.
Figure 6:
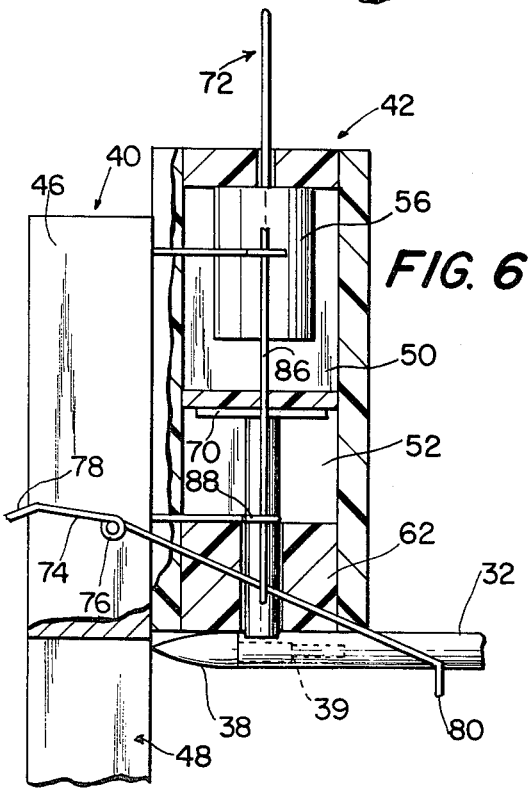
FIG. 6 is a view similar to FIG. 4, illustrating the position of the arrow when initially in magnetic engagement with the arrow rest.
Figure 7:
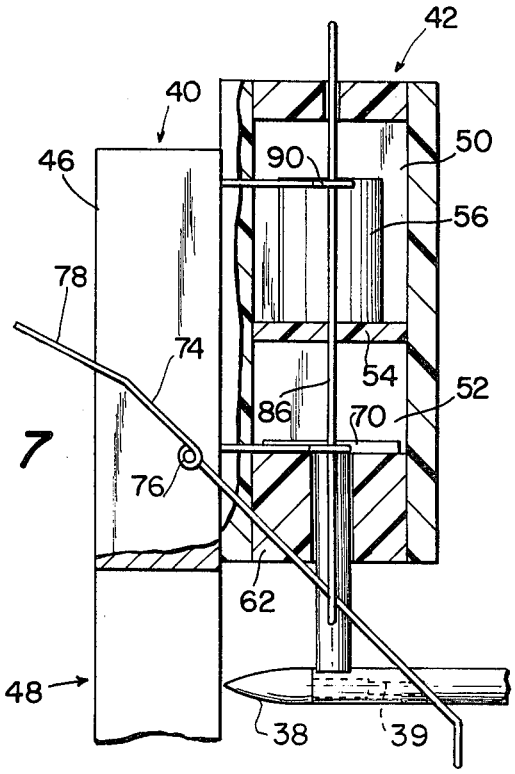
FIG. 7 is a view similar to FIG. 5, showing the position of the arrow and the magnet at full draw of the bow, just prior to release of the arrow.

A flexible line 96 extends from hook portion 94 of support arm 92 into fixed engagement with the upper end of magnet 56, so that, as vertical shaft 86 and support arm 92 are lifted in response to downward pressure on finger actuating member 78, arrow support 82 is raised into engagement with shaft 32 of arrow 30, as shown to advantage in FIG. 5. As arrow 30 is pulled to full draw, downward pressure on finger actuating member 78 is continued and arrow 30 is raised to a point contiguous with arrow rest 42, with arrow shaft 32 in engagement with the lower end of cylindrical magnet 66, the shaft being held in this position by the magnetic attraction of threaded portion 39 of arrow shaft 32 with magnet 66. (See FIG. 6.) It will be noted from a consideration of FIG. 4 that the arcuate end surface 68 of cylindrical magnet 66 effects greater surface area contact with arrow shaft 32. During the time when permanent magnet 56 is raised out of engagement with intermediate wall 54, as illustrated in FIG. 6, cylindrical magnet 66 is held at the top of the lower chamber 52 by the weaker magnetic field now present and by light frictional engagement of the cylindrical magnet with that portion of bottom wall 62 through which the magnet passes.

When the arrow is in full draw position as shown in FIG. 1, pressure on finger actuating member 78 is released, thereby effecting rotational movement of elongated arm 74 about pivot 76, with corresponding movement of arrow support 82 out of engagement with arrow 30.

In accordance with a principal object of the present invention, the weight of arrow 30 causes a downward movement of cylindrical magnet 66 until alignment member 70 is in engagement with the upper surface of bottom wall 62. (See FIG. 7.) At this point, arrow 30 is located in the dead center position of the bow for firing with no obstructions in the path of the arrow shaft or fletching to divert the arrow when it is fired.

Figure 2:
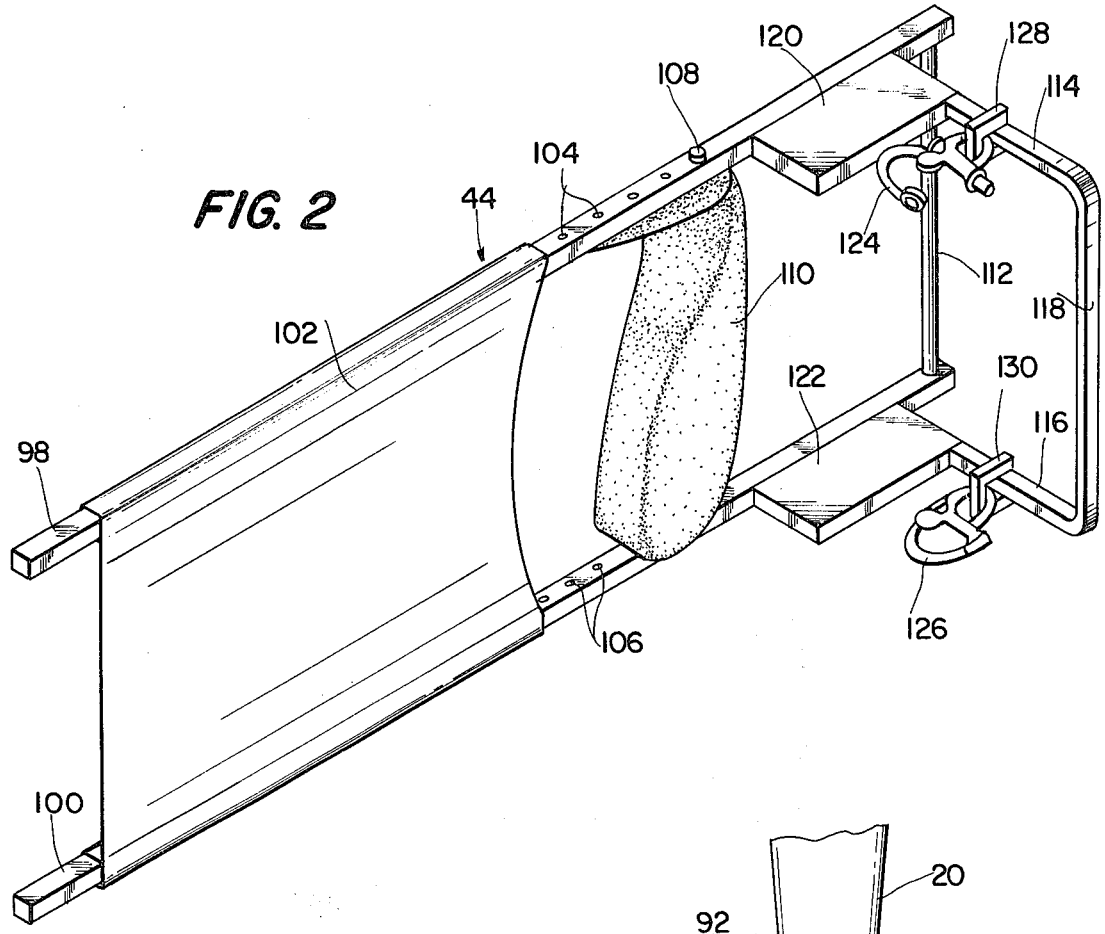
FIG. 2 is a perspective view of a combination archer's brace and arm guard forming a part of the present invention.
Figure 3:
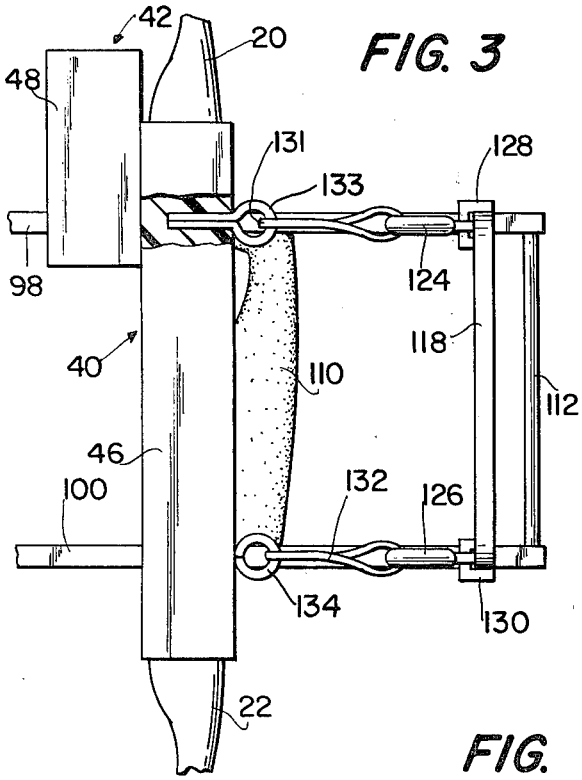
FIG. 3 is a fragmentary side elevational view of the present invention, portions thereof being broken away to disclose details of construction.

Referring now to FIGS. 1, 2 and 3 of the drawing, the combination archer's brace and arm guard 44 includes a main frame comprising a pair of elongated, parallel spaced members 98 and 100 having a solid sheet-like arm protector 102 extending therebetween, which protector may be made of leather or other suitable protective material.

Forwardly of arm protector 102, elongagted members 98 are provided with a series of aligned openings 104 and 106 through which an elongated bolt or the like 108 passes through a hand grip 110 of suitable shape and material, the series of openings 104 and 106 permitting the hand grip to be adjustably located at various points within the frame to suit individual needs and maintain the precise draw length of the bow without regard to the arm length of the archer. The adjustable hand grip enables the draw length of the bow to be standardized, so that all archers may shoot the same length arrows, preferably the shortest, lightest weight arrow with minimum spine needed for aerodynamic flight stability. It also permits individual needs to be met so that the precise draw length of the bow may be maintained without regard to the arm length of the archer. Brace and arm guard 44 further includes a connecting member 112 which joins the forwardmost terminals of elongated members 98 and 100.

Adjacent connecting member 112, spaced members 98 and 100 are connected by a free end of a C-shaped sub-frame which includes spaced, parallel members 114 and 116 and a connecting member 118. Braces 120 and 122 are fixedly secured to frame members 98 and 100 respectively of the main frame and parallel members 114 and 116 of the sub-frame. Conventional securing means 124 and 126 are secured to members 114 and 116 by supports 128 and 130 for detachably holding flexible lines 132 and 134 which are secured in any suitable manner to upper limb 20 and lower limb 22 in substantially equally-spaced relation to the dead center of the bow.

By this arrangement, when force is exerted by the archer on hand grip 110, force is directed by flexible lines 132 and 134 equally so that the resultant force on the bow is centrally of the bow, and the archer is not forced to push low on the handle of the bow as with conventional bows. Flexible lines 132 and 134 also dampen and minimize the effects of any movement of the archer's body while the bow is drawn.

The arm-engaging portion of brace and arm guard 44 is also an integral part of the brace portion and serves to stabilize the same under the considerable force exerted when the bow is drawn.

DETAILED DESCRIPTION OF THE INVENTION ILLUSTRATED IN FIGS. 8 AND 9

Figure 8:
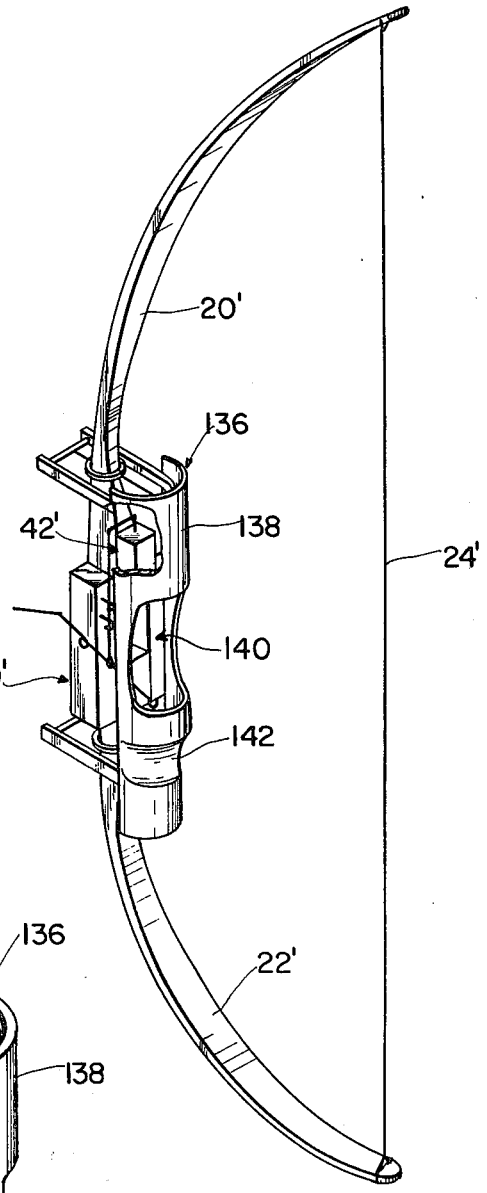
FIG. 8 is a perspective view of the archery bow of the present invention, illustrating a modified archer's brace.
Figure 9:
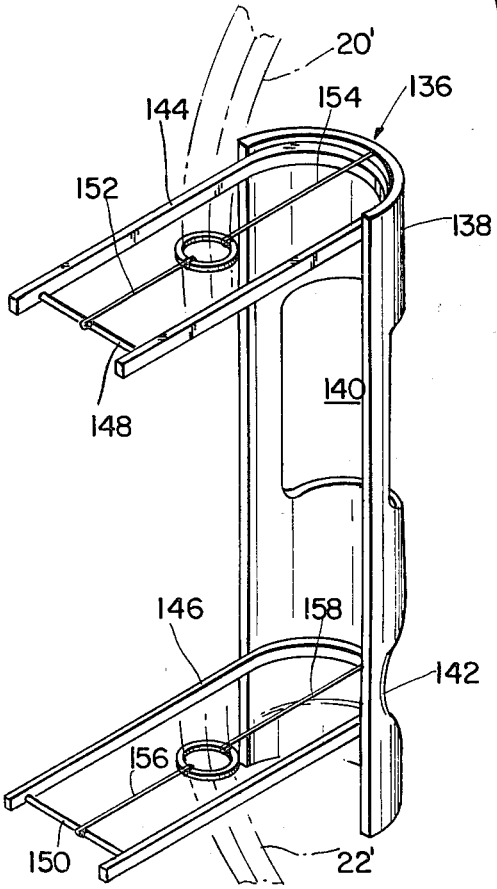
FIG. 9 is an enlarged perspective view of the modified archer's brace of FIG. 7.

In FIGS. 8 and 9, there is illustrated a modified form of archer's brace which is generally designated 136, and which is adapted to be engaged with the bow in the manner illustrated in FIG. 8. Parts of the bow which are similar to that shown in the form of invention illustrated in FIGS. 1 to 7 are identified by like, prime numbers.

Brace 136 includes a substantially semi-cylindrical body portion 138 having an opening 140 intermediate the length thereof, which opening is located centrally of the bow and aligned with central opening 48′ of block member 46′. Proximate the lower end of the brace, semi-cylindrical body member 138 is provided with a peripheral indentation 142 adapted for engagement by a portion of the archer's hand to serve as a hand grip.

In accordance with this form of the invention, there are provided upper and lower U-shaped connectors 144 and 146, the central portion of which is secured by adhesives or other suitable means to the complemental concave surface of semi-cylindrical member 136 adjacent the upper and lower terminals thereof, which U-shaped members straddle the upper and lower limbs 20' and 22' of the bow. The free terminals of U-shaped members 144 and 146 are joined by connecting members 148 and 150.

A flexible line 152 extends from cross member 148 to upper limb 20' and a second flexible line 154 extends from body member 138 to upper limb 20' in order to permit limited movement of brace 136 when force is exerted by the archer thereon.

Similarly, a flexible line 156 extends from cross member 150 to lower limb 22' and a second flexible line 158 extends from member 138 to lower limb 22'. Flexible lines 152 and 156 are engaged with upper and lower limbs 20' and 22' at points which are substantially equidistant from the center of the bow.

The operation of the modified bow is the same as in the form of invention illustrated in FIGS. 1 to 7, with the exception that there is limited movement possible of body member 138 either toward or away from the bow, while at the same time permitting tension-free force to be exerted thereon, the resultant force on the bow being directed centrally thereof.

If desired, the brace and arm guard 44 employed in the form of invention illustrated in FIGS. 1 to 7 may be employed to push archer's brace 136 by connecting the subframe to semi-cylindrical body portion 138.

The archery bow of the present invention affords simple but effective means for modifying existing bows to improve the archer's accuracy by providing automatic centering of the arrow with respect to the bow, and the removal of obstructions on the bow which have heretofore deflected the arrow when fired. This invention further produces a dead center draw that is completely tension-free and enables the bow to be drawn with a hand-to-hand pull instead of the traditional push-pull draw that has been heretofore used universally.

While there has been herein shown and described the presently preferred form of the present invention, it is to be understood that such has been done for purposes of illustration, and that various changes may be made therein within the scope of the appended claims.

What I claim is:

1. In combination with an arrow including a shaft having a pile at one end of magnetic material and fletching at the other end of the shaft, an archery bow comprising:

(a) upper and lower limbs
(b) a bow string connecting the remote terminals of said upper and lower limbs, and
(c) an arrow rest for the arrow mounted on said upper limb of the bow
(d) said arrow rest including a stationary member
(e) a movable magnetic member supported by said stationary member and movable downwardly to a point centrally of the bow, and
(f) first means for limiting the downward movement of said magnetic member, whereby said magnetic member magnetically engages the pile of said arrow as the latter is moved to full draw, and the magnetic member is urged to its lowermost position under the weight of said arrow until the arrow is dead center of the bow.

2. The archery bow of claim 1, with the addition of:
(a) a second means for retracting said movable magnetic member upon firing the arrow, to move the former out of the path of the fletching.

3. The archery bow of claim 2, wherein:
(a) said second means comprises a second magnetic member engaged with said stationary member which magnetically attracts said movable magnet member to effect vertical movement of the latter.

4. The archery bow of claim 1, wherein:
(a) said movable magnetic member is of elongated cylindrical shape.

5. The archery bow of claim 4, wherein:
(a) the lower terminal of said movable magnetic member is of arcuate shape to complement and magnetically engage the outer periphery of the arrow pile.

6. The archery bow of claim 5, with the addition of:
(a) a third means for preventing rotation of said movable magnetic member.

7. The archery bow of claim 1, wherein:
(a) said upper and lower limbs are spaced apart at the center of the bow, and
(b) offset connector means join the adjacent ends of said upper and lower limbs.

8. The archery bow of claim 1, with the addition of:
(a) a hand brace including a frame member
(b) a hand grip mounted on said frame member, and
(c) spaced, flexible members carried by said frame member and engaged with said upper and lower limbs, whereby, when the arrow is pulled to draw position, the force on the bow is concentrated at the center thereof.

9. An archery bow comprising:
(a) upper and lower limbs
(b) a bow string connecting the remote terminals of said upper and lower limbs
(c) said upper and lower limbs being spaced apart
(d) connecting means offset from the longitudinal axis of said bow for joining said upper and lower limbs
(e) a hand brace including a body member having a central opening aligned with the dead center of the bow
(f) said body member including a hand-engaging portion, and
(g) flexible line means carried by said body member and engaged with said upper and lower limbs at points spaced from the remote terminals thereof, at least a portion of said line means located forwardly of said bow limbs, whereby upon force being exerted on said hand-engaging portion, tension is exerted on said upper and lower limbs adjacent the center of the bow to effect a resultant force centrally of the bow.

10. The archer bow of claim 9, wherein:
(a) said body member includes a main frame, and
(b) a sub-frame at a substantially right angle to said main frame
(c) said sub-frame having an opening aligned with the center of the bow.

11. The archery bow of claim 10, wherein:
(a) said main frame includes a pair of spaced, parallel members
(b) said hand-engaging portion including hand grip positioned between said spaced, parallel members.

12. The archery bow of claim 11, with the addition of:

(a) means for movably and adjustably positioning said hand grip portion between said spaced, parallel members.

13. The archery bow of claim 12, wherein:

(a) said sub-frame is of substantially C-shape construction, the free ends of said sub-frame being fixed to said spaced, parallel members.

14. The archery bow of claim 13, with the addition of:

(a) an arm guard inserted between, and secured to, said spaced, parallel members.

15. The archery bow of claim 13, wherein:

(a) said sub-frame is in advance of said bow, whereby the bow is drawn by pushing on said hand grip portion with one hand to effect a forward pull on the bow as the bow string is pulled with the other hand.

16. The archery bow of claim 9, wherein:

(a) said hand brace includes an elongated member positioned centrally and rearwardly of said bow (b) said elongated member having a central opening aligned with the dead center of the bow (c) rigid support members extending from said elongated member to a point forwardly of said bow (d) said flexible lines extend from said elongated member to said upper and lower limbs and from said rigid support members to said upper and lower limbs.

17. The archery bow of claim 16, wherein:

(a) said elongated member is of generally semi-cylindrical shape (b) a portion of said semi-cylindrical member being indented to provide a hand grip.

18. The archery bow of claim 16, wherein:

(a) said upper and lower limbs are spaced apart, and (b) connecting means offset from the longitudinal axis of said bow for joining said upper and lower limbs.

(c) the central opening of said hand brace frame being aligned with the center of said bow.

19. In combination with an arrow including a shaft having a pile of magnetic material at one end and fletching at the other end of the shaft, an archery bow comprising (a) upper and lower limbs (b) a bow string connecting the remote terminals of said upper and lower limbs (c) a connector block member joining said upper and lower limbs (d) said connector block member having a central opening aligned with the center of the bow (e) an arrow rest for the arrow mounted on said connector block member (f) said arrow rest including a stationary box-like housing having an upper chamber and a lower chamber divided by an intermediate wall (g) a large permanent magnet within said upper chamber normally resting on said intermediate wall (h) an elongated magnet positioned in said lower chamber and normally held therein by magnetic attraction to said permanent magnet (i) said arrow rest further including a combination permanent magnet lifter and arrow support comprising an elongated arm pivotally engaged intermediate its length with said connector block member (j) one end of said elongated arm serving as a finger actuating member for rotating the arm about its pivot (k) the other end of said elongated arm being bent for use as an arrow support whereby, when said elongated arm is moved in a direction to raise said arrow support, the pile of the arrow engages said elongated arm and is magnetically attracted thereto upon the bow being pulled to full draw position (l) a vertical shaft connected to said connector block member and engaged with said elongated arm for reciprocating vertical movement in response to corresponding vertical movement of the latter (m) a support arm extending at a right angle to the upper end of said vertical shaft (n) a flexible line extending from said support arm into fixed engagement with the upper end of said permanent magnet so that, as said vertical shaft and support arm are lifted in response to downward pressure on said finger actuating member, said permanent magnet is raised out of engagement with said intermediate wall, whereby the weight of the arrow causes a downward movement of said cylindrical magnet, and (o) means for limiting the downward limit of said cylindrical magnet to locate the arrow in dead center position of said bow.

20. The archery bow of claim 19, wherein (a) said boxlike housing is provided with a bottom wall having an opening through which said cylindrical magnet passes, and (b) a rectangular alignment member connected to the upper end of said cylindrical magnet and normally engaged with said intermediate wall (c) said alignment member engaging said bottom wall to limit the downward movement of said cylindrical magnet upon magnetic engagement of the arrow pile with the cylindrical magnet.

* * * * *